US008693900B2

(12) United States Patent
Shiraishi

(10) Patent No.: US 8,693,900 B2
(45) Date of Patent: Apr. 8, 2014

(54) IMAGE FORMING DEVICE

(75) Inventor: Toyokazu Shiraishi, Tokyo (JP)

(73) Assignee: Oki Data Corporation, Tokyo (JP)

( * ) Notice: Subject to any disclaimer, the term of this patent is extended or adjusted under 35 U.S.C. 154(b) by 112 days.

(21) Appl. No.: 13/348,058

(22) Filed: Jan. 11, 2012

(65) Prior Publication Data

US 2012/0177389 A1 Jul. 12, 2012

(30) Foreign Application Priority Data

Jan. 12, 2011 (JP) ..... 2011-004057

(51) Int. Cl.
*G03G 15/20* (2006.01)

(52) U.S. Cl.
USPC ..... 399/43; 399/69

(58) Field of Classification Search
USPC ..... 399/43
See application file for complete search history.

(56) References Cited

U.S. PATENT DOCUMENTS

2009/0317103 A1* 12/2009 Furukawa et al. ..... 399/49

FOREIGN PATENT DOCUMENTS

| | | | | |
|---|---|---|---|---|
| JP | 2001-261206 A | * | 9/2001 | ..... B65H 23/18 |
| JP | A-2001-261206 | | 9/2001 | |
| JP | 2007-216618 A | * | 8/2007 | ..... B41J 11/42 |
| JP | A-2007-216618 | | 8/2007 | |
| JP | A-2008-135900 | | 6/2008 | |

* cited by examiner

*Primary Examiner* — Clayton E LaBalle
*Assistant Examiner* — Jas Sanghera
(74) *Attorney, Agent, or Firm* — Muncy, Geissler, Olds & Lowe, P.C.

(57) ABSTRACT

An image forming device includes a carrying part, an image forming part, a fuser, a fusion temperature controller, a winding part, a storage part and a controller. The controller stops a carrying of recording medium by the carrying part and heating by the fusion temperature controller, after the carrying part carries the recording medium by a predetermined length while the fusion temperature controller heats the fuser, when printing is started in a state where the recording medium is not wound on the winding part, and resumes the carrying of the recording medium by the carrying part and the heating by the fusion temperature controller upon detection that the time measured by the measurement part has reached the stop time for the recording medium stored in the storage part.

16 Claims, 10 Drawing Sheets

IMAGE FORMING DEVICE

CROSS REFERENCE TO RELATED APPLICATION

The present application is related to, claims priority from and incorporates by reference Japanese patent application No. 2011-004057, filed on Jan. 12, 2011.

TECHNICAL FIELD

This application relates to an electrographic type image forming device that prints an image on a continuous recording medium.

BACKGROUND

A conventional image forming device includes a winding part that winds a long recording medium after printing. Such a conventional image forming device stops after feeding the recording medium by a predetermined length when a recording medium begins to be wound. Then, after the user fixes the front end part of the recording medium to a core of a winding part, the conventional image forming device feeds the recording medium further and rotates the winding part to wind the recording medium. (See, for example, paragraphs [0023]-[0024] and FIG. 9 of Japanese Laid-Open Patent Application No. 2001-261206.)

With conventional technology, to prevent a color change of the recording medium, a heater of a fuser that fixes the toner on the recording medium needs to be stopped until the recording medium is fed out after the recording medium is fed by the predetermined length and stopped and after the user fixes the front end of the recording medium to the winding part core. However, because the temperature inside the fuser decreases during this time, an unnecessary length of print medium is fed until the fuser reaches a predetermined fusible (printable) temperature range. To solve the above-described problem, this application has an object to suppress the feeding of the unnecessary length of print medium at the start of the printing.

SUMMARY

In order to solve the problem, this application discloses an image forming device including: a carrying part that carries a continuous length of a recording medium as the recording medium in a roll is unrolled; an image forming part that forms a development image on the recording medium carried by the carrying part; a fuser that thermally fixes the development image formed on the recording medium; a fusion temperature controller that controls a temperature of the fuser in accordance with the carrying of the recording medium by the carrying part; a winding part that winds the recording medium on which the development image is thermally fixed; a measurement part that measures a stop time, during which the carrying part stops the carrying of the recording medium; a storage part that stores the stop time for the recording medium as operation time for attaching a front end of the recording medium onto the winding part; and a controller that stops the carrying of the recording medium by the carrying part and heating by the fusion temperature controller, after the carrying part carries the recording medium by a predetermined length while the fusion temperature controller heats the fuser, when printing is started in a state where the recording medium is not wound on the winding part, and that resumes the carrying of the recording medium by the carrying part and the heating by the fusion temperature controller upon detection that the time measured by the measurement part has reached the stop time for the recording medium stored in the storage part.

The present application has an advantage to suppress the feeding of the unnecessary length of print medium at the start of printing.

DETAILED DESCRIPTION OF EMBODIMENTS

Embodiments of an image forming device according to the present application are explained below with reference to the drawings.

First Embodiment

Figure 2:
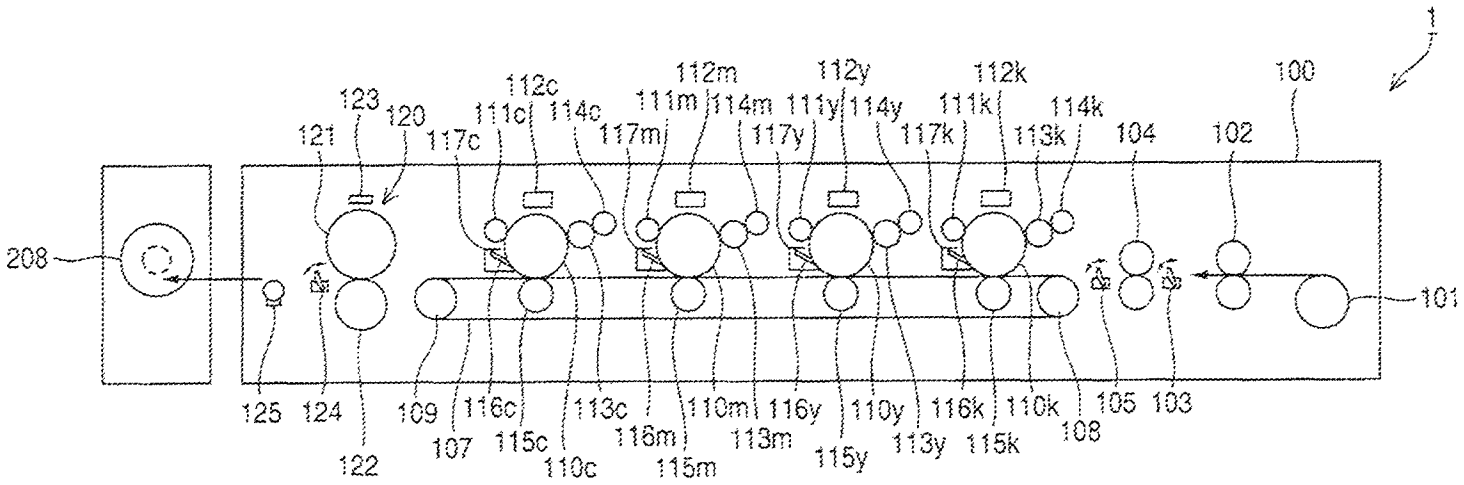
FIG. 2 is a schematic cross-sectional view illustrating the configuration of the image forming device according to the first embodiment.

FIG. 2 is a schematic cross-sectional view illustrating the configuration of the image forming device according to the first embodiment. In FIG. 2, an image forming device 1 is configured from an electrographic printer 100 that forms an image on a recording medium, and a winding part 208 that winds thereon a continuous recording medium ejected from the electrographic printer 100.

A recording medium 101 is a continuous, long sheet in a roll. A first registration part 102 is a roller pair that carries the recording medium 101 to a second registration part 104. The second registration part 102 is a roller part that carries the recording medium 101 to the later-discussed image forming part. A first medium detection part 103 that is configured by a sensor that detects the presence of the recording medium 101 is positioned between the first registration part 102 and the second registration part 104. In addition, a second medium detection part 105, which is configured from a sensor that detects a front end of the recording medium 101 carried by the second registration part 104, is positioned in the downstream of the second registration part 104 in the recording medium carrying direction.

An image forming mechanism that forms an image is configured from a photosensitive body, such as a photosensitive drum 110, as an image carrier, a charging roller 111 that charges the photosensitive drum 110, an exposure part 112 that forms latent images on the photosensitive drum 110, a development part 113 that forms toner images as developer images at parts of the photosensitive drum 110 where the latent images have been formed, a toner supply part 114 that supplies toner to the development part 113, a transfer part 115 that transfers the toner images formed on the photosensitive drum 110 onto the recording medium 101, a cleaning part 116 that removes the toner remained on the photosensitive drum 110 after the transfer, and a waste toner box 117 that collects the removed toner.

The electrographic printer 100 of the present embodiment includes four image forming mechanisms, as tandem color mechanisms, that form toner images in black (k), yellow (y), magenta (m) and cyan (c), respectively. The image forming mechanisms are arranged in the order of black (k), yellow (y), magenta (m) and cyan (c) along the carrying direction of the recording medium 101. Suffixes (k, y, m, c) indicating the respective colors are added at ends of reference numerals 110 to 117.

The recording medium 101 is carried by a transfer belt 107 between the photosensitive drum 110 and the transfer part 115 of each color. The transfer belt 107 extends between a transfer belt drive part 106 and an idle roller 108. The transfer belt drive part 109 is a roller that drives the transfer belt 107 by rotation. The idle roller 108 adjusts a tension of the transfer belt 107. The transfer belt 107 rotates in the counterclockwise direction in the drawing to carry the recording medium 101.

In the downstream of the image forming part for cyan (c) in the carrying direction of the recording medium 101, a fuser 120 that fixes the toner images transferred onto (formed on) the recording medium 101 onto the recording medium 101 by heat and pressure is arranged.

The fuser 120 is configured from a fusion roller 121, in which a heater is provided, a pressure application roller 122 positioned so that the outer circumferential surface thereof contacts the outer circumferential surface of the fusion roller 121. The fusion roller 121 and the pressure application roller 122 pinch the recording medium 101 carried thereto, fix the toner images onto the recording medium 101 by heat and pressure, and carry the recording medium 101. Moreover, a temperature detection part 123 configured from a sensor that detects a surface temperature of the fusion roller 121 is provided in the vicinity of the fusion roller 121.

In the downstream of the fuser 120 in the carrying direction of the recording medium 101, a third medium detection part 124 configured from a sensor that detects the presence of the recording medium 101 that has passed the fuser 120 is provided. In addition, in the downstream of the third medium detection part 124 in the carrying direction of the recording medium 101, a rotation sensor 125 that detects a state of the carrying of the recording medium 101 is provided. The rotation sensor 125 is configured from a Hall element and is a sensor that outputs a periodic pulse when the sensor detects the recording medium 101 being carried. The recording medium 101 carried by the fuser 120 is ejected from an ejection opening.

A winding part 208 is provided in the downstream of the ejection opening of the electrographic printer 100. The winding part 208 is a mechanism (winder) that winds by a winding roller the recording medium 101 ejected from the electrographic printer 100 after the toner has been fixed by the fuser 120. The winding part 208 rotates the winding roller and includes a switch (not shown) that stops the rotation.

Figure 1:
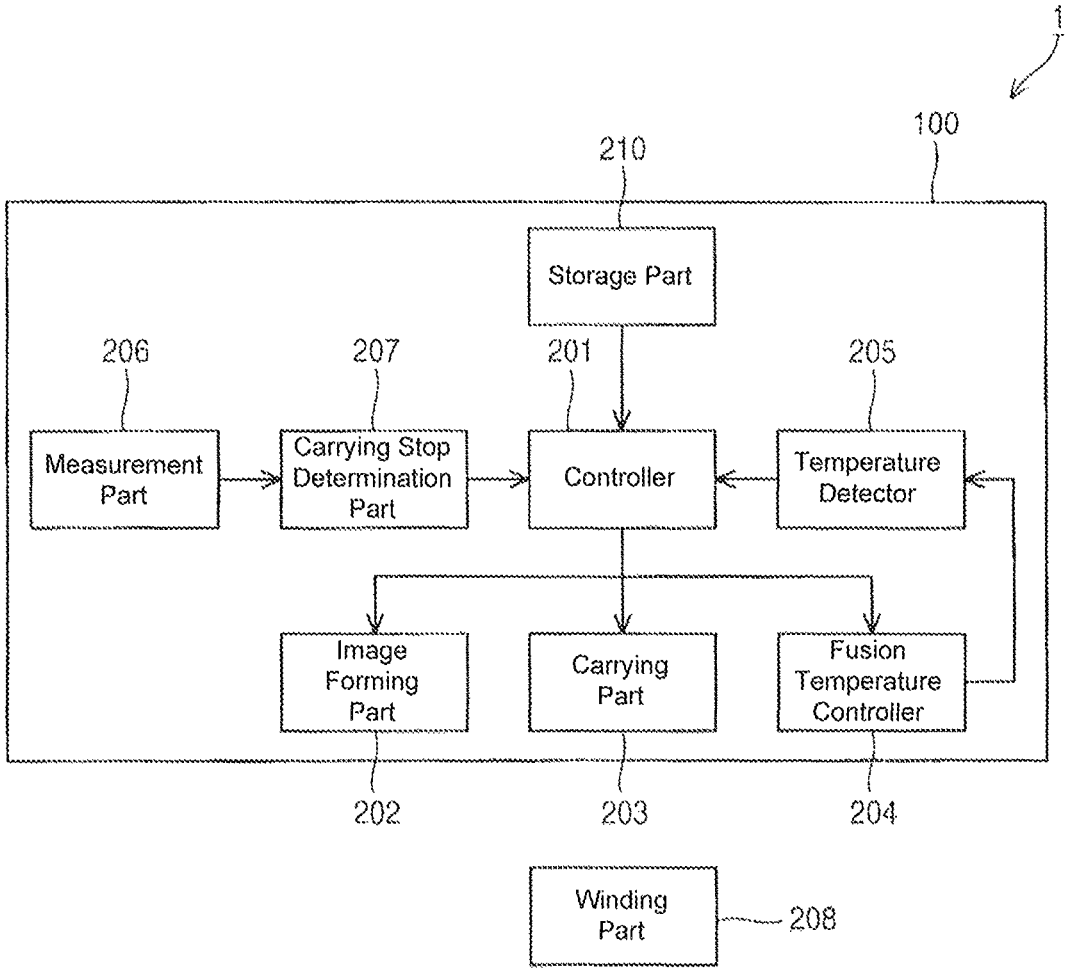
FIG. 1 is a block diagram illustrating a configuration of an image forming device according to a first embodiment.

FIG. 1 is a block diagram illustrating a configuration of the image forming device according to the first embodiment. In FIG. 1, the image forming device 1 is configured from the winding part 208 and the electrographic printer 100 that includes a controller 201, an image forming part 202, a carrying part 203, a fusion temperature controller 204, a temperature detector 205, a measurement part 206, a carrying stop determination part 207 and a storage part 210.

The controller 201 is configured from a central processing unit (CPU) as a calculating device as well as a controlling device and the like and controls operation of the entire electrographic printer 100 based on control programs stored in the storage part 210 configured from a memory or the like. The image forming part 202 forms a development image on the recording medium using the image forming mechanism based on print data received from a host device (not shown), in accordance with an instruction from the controller 201.

The carrying part 203 controls a drive source, such as a motor or the like, in accordance with an instruction from the controller 201 and controls to carry, and stops the carrying of, the continuous recording medium by the registration part, the transfer belt and the fuser shown in FIG. 2. The fusion temperature controller 204 performs a temperature control for the fuser for fixing the toner image formed on the recording medium onto the recording medium in accordance with an instruction from the controller 201. The fusion temperature controller 204 performs a fusion temperature control to heat, and to stop the heating of, the fusion roller 121 in accordance with the carrying of the recording medium, using the heater in the fusion roller 121 of the fuser 120 shown in FIG. 2.

The temperature detector 205 detects a temperature of the fuser and notifies the controller 201 of the detected temperature. The temperature detector 205 also detects a surface temperature of the fusion roller 121 using the temperature detection part 123 shown in FIG. 2 and notifies the controller 201 of the detected surface temperature of the fusion roller 121. The measurement part 206 includes a timing device, such as a timer or the like and measures time during which the carrying part 203 carries the recording medium time during which the carrying part 203 is in stop to carry the recording medium.

The carrying stop determination part 207 determines the carrying of, and the stopping of the carrying of, the recording medium based on the elapsed time measured by the measurement part 206 and notifies the controller 201 of the carrying and the stopping of the carrying of the recording medium. The winding part 208 winds with the winding roller the recording medium ejected from the electrographic printer 100 after the toner images have been fixed. The winding part 208 rotates the winding roller and includes a switch (not shown) that stops the rotation. The winding part 208 operates independently from the controller 201. The winding may be automatically commenced by providing a sensor or the like to detect the ejection of the recording medium 101 from the electrographic printer 100 (fuser 120) or to detect the resuming of the carrying of the recording medium 101 by the carrying part 203, without providing the switch.

The storage part 210 stores various information for the controller 201 to control the operation of the entire image forming device 1 and stores stop time for the recording medium as operation time for attaching (winding) a front end of the recording medium to the core of the winding part 208. In addition, the storage part 210 stores a state as to whether or not the recording medium 101 has been wound on the winding part 208.

When the printing starts in a state where the recording medium has not been wound on the winding part 208, the controller 201 of the image forming device 1 as configured above causes the carrying part 203 to carry the recording medium by a predetermined length while causing the fusion temperature controller 204 to heat the recording medium, and then stops the carrying of the recording medium by the carrying part 203 and the heating by the fusion temperature controller 204. The controller 201 also resumes the carrying of the recording media by the carrying part 203 and the heating by the fusion temperature controller 204 upon a detection that the time measured by the measurement part 206 has reached the stop time for the recording medium stored in the storage part 210.

Figure 3:
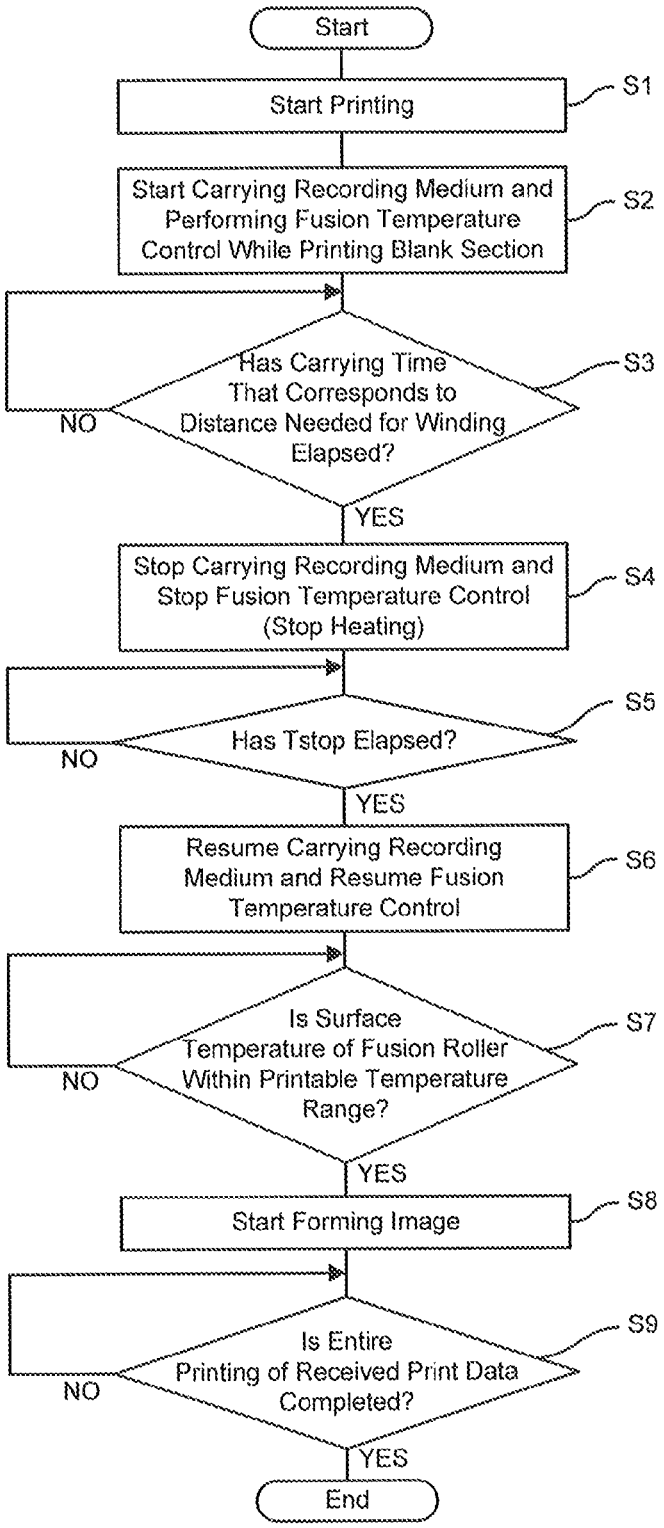
FIG. 3 is a flow diagram illustrating a print process in the first embodiment.

Operation of the above-described configuration is explained in accordance with steps indicated by "S" in a flow diagram of FIG. 3 illustrating a print process according to the first embodiment, with reference to FIGS. 1 and 2. First, the image forming device 1 is assumed to be in a state where the recording medium 101 has not been wounded on the winding part 208.

S1: The controller 201 starts printing when print data is received from a host device.

S2: The controller 201 that has started the printing outputs to the image forming part 202 an instruction to print a blank section and outputs to the carrying part 203 an instruction to carry the recording medium 101. In addition, the controller 201 sets the fusion temperature for the fuser 120 to the optimum fusion temperature for the recording medium 101 and outputs to the fusion temperature controller 204 an instruction to perform a fusion temperature control so that the fuser 120 becomes to the fusion temperature.

S3: The carrying part 203 carries the recording medium 101 while printing the blank section. The measurement part 206 starts timing when the front end of the recording medium 101 is detected by the third detection part 124. The carrying stop determination part 207 notifies the controller 201 of the stopping of the carrying of the recording medium 101 when the measurement part 206 detects that carrying time that corresponds to a predetermined ejection distance needed for the recording medium 101 to be wound on the winding part 208 has elapsed.

S4: The controller 201 that has received the noticed that the carrying of the recording medium 101 had stopped outputs an instruction to the carrying part 201 to stop the carrying of the recording medium 101 and outputs an instruction to the fusion temperature controller 204 to stop the fusion temperature control for the fuser 120 (to stop the heating by the heater). The carrying part 203 that has received the instruction to stop the carrying of the recording medium 101 stops the carrying of the recording medium 101. The fusion temperature controller 204 that has received the instruction to stop the fusion temperature control stops the fusion temperature control. Here, the reason to stop the fusion temperature control for the fuser 120 when the carrying of the recording medium 101 is stopped is because the color of the recording medium 101 changes if heat is applied to the recording medium 101 at a contact part (nip part) of the fusion roller 121 and the pressure application roller 122 for a long period of time.

S5: When the carrying part 203 stops the carrying of the recording medium 101, the measurement part 206 initializes a timer value for the timing device and starts measuring stop time Tstop for the recording medium 101 from a point when the carrying of the recording medium 101 is stopped. When an elapse of the stop time Tstop is detected, the process moves to S6. The stop time Tstop is time for the user to attach the front end of the recording medium 101 to the winding part 208. The stop time Tstop is preset at the storage device and is preferably in a range of 10 to 30 seconds.

Figure 5A:
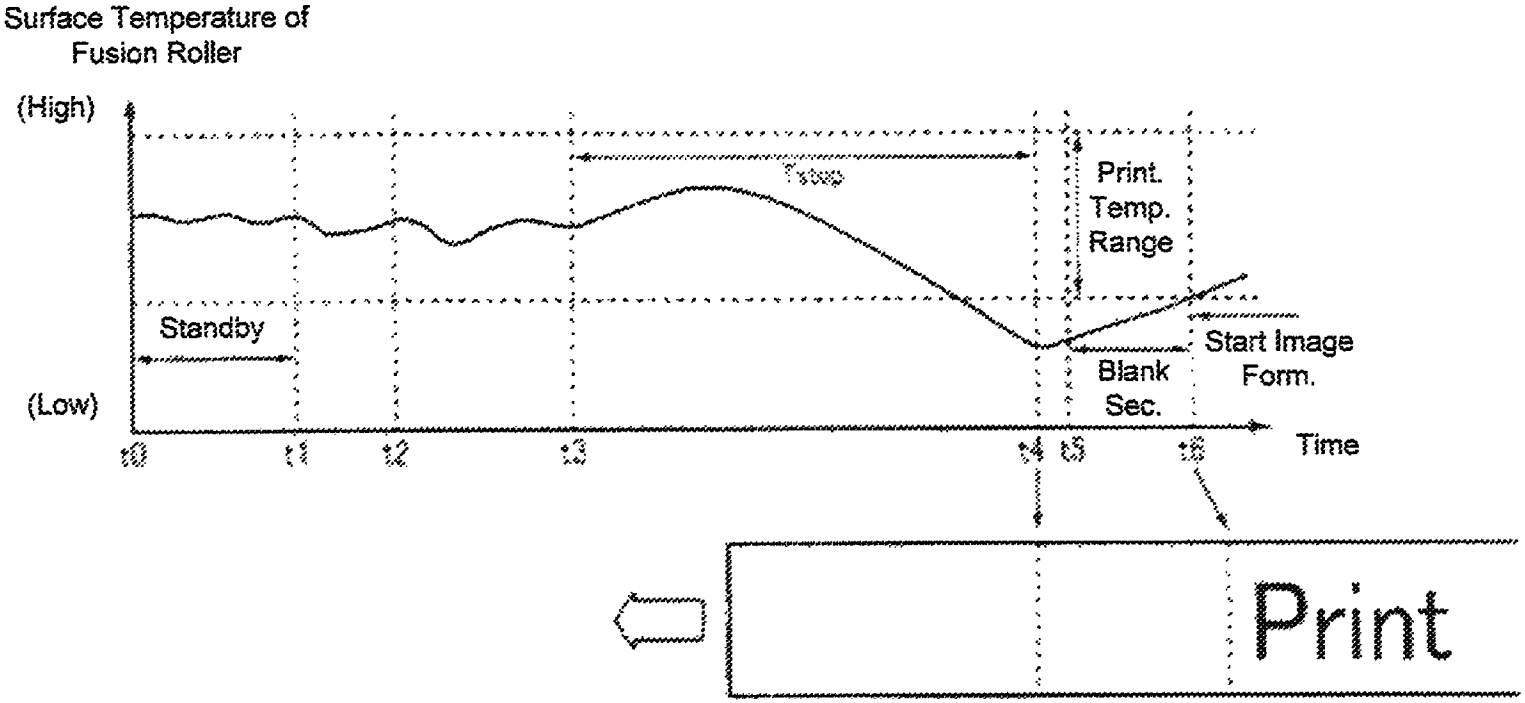
FIGS. 5A and 5B are diagrams explaining a surface temperature of a fusion roller in the first embodiment.
Figure 5B:
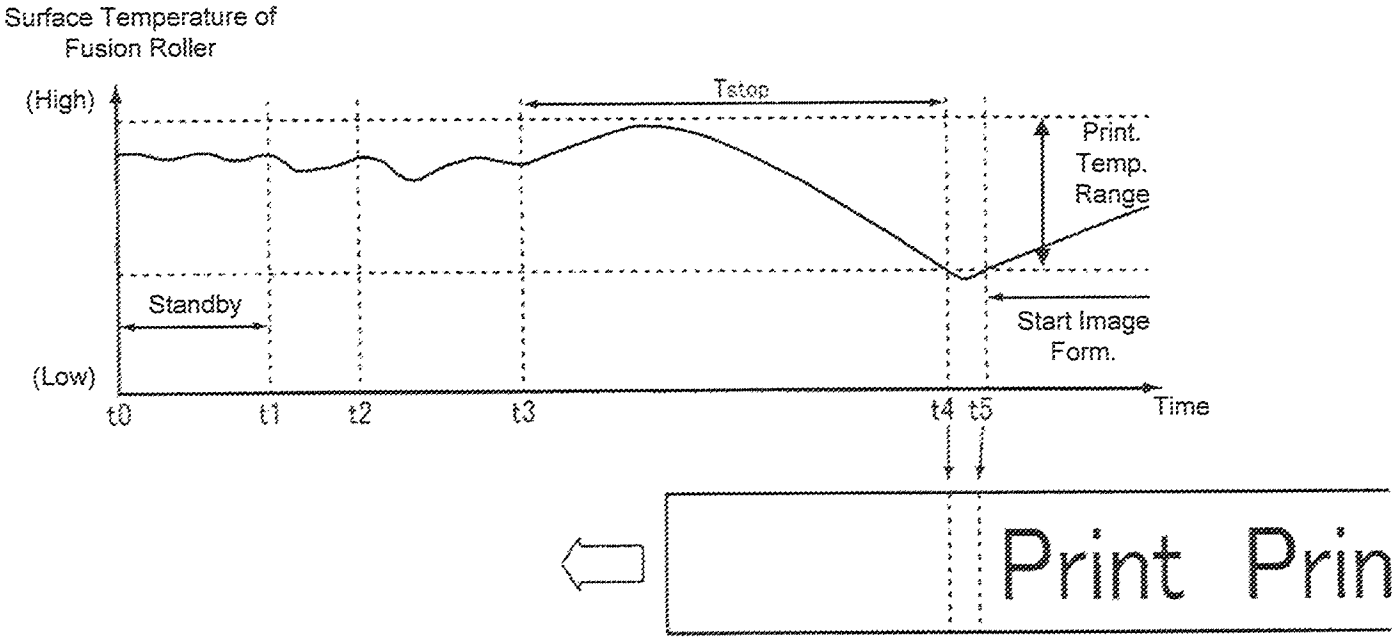

FIGS. 5A and 5B are graphs showing a change in the surface temperature of the fusion roller 121. The vertical axis indicates the surface temperature of the fusion roller 121, and the horizontal axis indicates the time elapsed. In FIG. 5A, the section from the times t0 to t1 is when the electrographic printer 100 is in a print standby state, in which the surface temperature of the fusion 121 changes around a fusion target temperature in a printable temperature range. The section from the times t1 to t2 is a section in which the printing initiates and the fusion roller 121 and the pressure application roller 122 start rotating. At this time, the carrying of the recording medium 101 is also started. At the time t2, the front end of the recording medium 101 reaches the fusion roller 121. At the time t3, a predetermined length of the recording medium 101 necessary for the front tip of the recording medium 101 to be wound on a core of the winding part 208 is carried and ejected from the electrographic printer 100, and the carrying of the recording medium 101 stops.

Figure 4A:
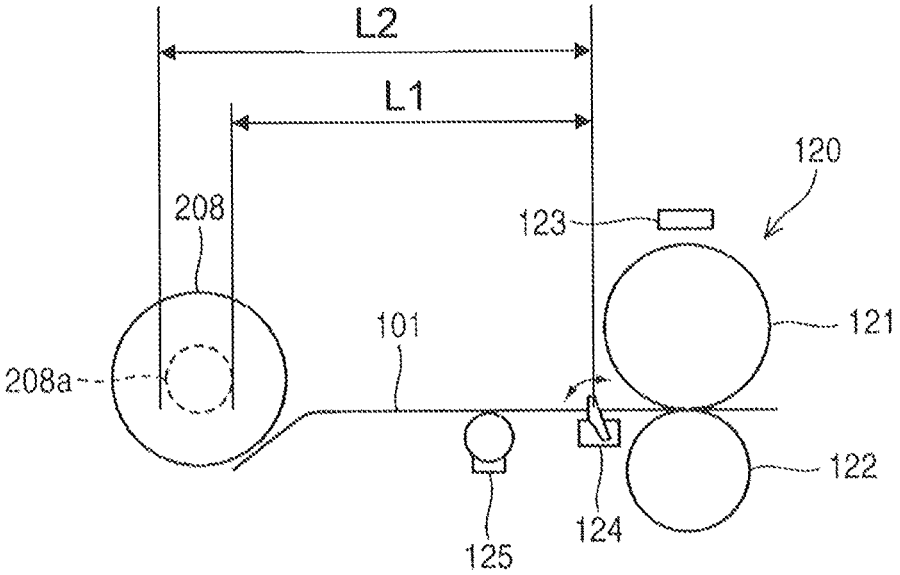
FIGS. 4A and 4B are explanatory diagrams illustrating a position of a print medium at the time of winding in the first embodiment.
Figure 4B:
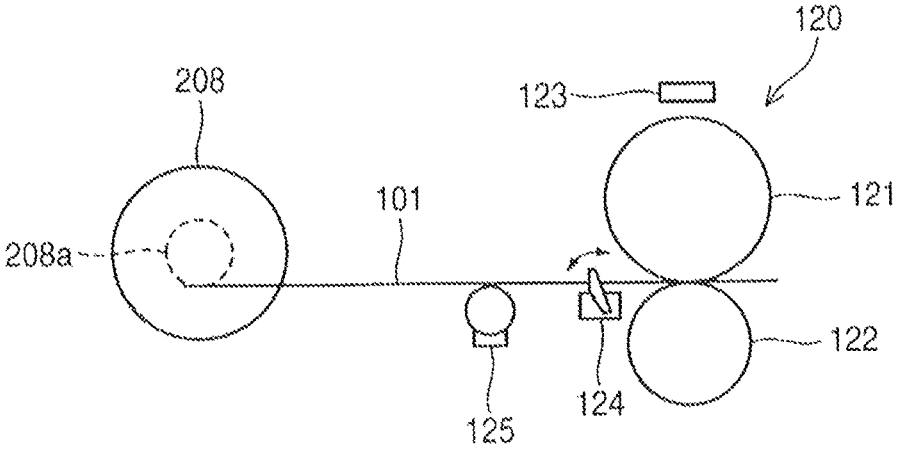

As a reference for determining the predetermined length of the recording medium 101 necessary for winding on the winding part 208, a length that allows the front end of the recording medium 101 to reach a core 208*a* of the winding part 208 as shown in FIG. 4A and to be fixed by taping or the like is sufficient. In the embodiment, the length necessary for winding is defined as a length that is longer than L1 (from third detection part 124 to the closest portion of the core 208*a*). Also, it is preferred that the necessary length is up to L2 (from the third detection part 124 to the farthest portion of the core 208*a*) or more. See FIG. 4. Furthermore, lengths L1 and L2 may be defined from a nip part of the rollers 121 and 122, specifically where the detection part is positioned between the nip part and the winding part 208.

The section from the times t3 to t4 is the stop time Tstop and is the time during which the front end of the recording medium 101 to be attached to the core of the winding part 208 by user operation. If the stop time Tstop is too short, misattachment occurs easily, causing an increase of a risk to introduce carrying problems, such as an oblique carrying of the recording medium 101 thereafter. On the other hand, if the stop time Tstop is too long, the surface temperature of the fusion roller 121 significantly deviates from the printable temperature range at the time t4. This results in a state in which the image formation cannot be performed until the surface temperature of the fusion roller 121 enters the printable temperature range, even if the recording medium 101 is carried and if the fusion temperature control for the fuser 120 is performed. As a result, the printing of the blank section is unnecessarily continued. In consideration of these facts, the stop time Tstop is determined as 10 to 30 seconds, for example.

In addition, as shown in FIG. 5B, by setting a target temperature of the fuser at the time t3 at which the carrying of the recording medium 101 is stopped, that is, a target temperature of the fuser while the carrying part 203 carries the recording medium 101, higher than the median of, and closer to the upper limit of, the printable temperature range, time that the surface temperature of the fusion roller 121 stays within the printable temperature range can be extended, thereby securing the stop time Tstop long.

S6: Returning to the explanation of FIG. 3, when the measurement part 206 detects that the stop time Tstop has elapsed, the carrying stop determination part 207 notifies the controller 201 of the carrying of the recording medium 101 to be resumed. The controller 201 that has received the notice instructs the carrying part 203 to resume the carrying of the recording medium 101 and the fusion temperature controller 204 to resume the fusion temperature control for the fuser 120. The carrying part 203 that has received the instruction resumes the carrying of the recording medium 101, and the fusion temperature controller 204 resumes the fusion temperature control for the fuser 120. At the same time, the winding of the recording medium 101 is commenced as the operator turns on a switch (not shown) for the winding part 208. As described above, the winding may be automatically commenced by providing a sensor or the like to detect the ejection of the recording medium 101 from the electrographic printer 100 (fuser 120) or to detect the resuming of the carrying of the recording medium 101 by the carrying part 203, without providing the switch. The controller 201 at this time stores in the storage part 210 the state that the recording medium 101 is being wound on the winding part 208.

S7: After resuming the carrying of the recording medium 101 and the fusion temperature control for the fuser 120, the controller 201 determines whether or not an output value of the temperature detector 205 that detects the surface temperature of the fusion roller 121 by the temperature detection part (sensor) 123 shown in FIG. 2 is within the printable temperature range, that is, whether or not the temperature of the fuser 120 is within the printable temperature range. As a result, if the surface temperature of the fusion roller 121 is determined within the printable temperature range, the process moves to S8 and starts the image formation. On the other hand, if the surface temperature of the fusion roller 121 is determined outside the printable temperature range, the output value of the temperature detector 205 is continuously checked until the surface temperature of the fusion roller 121 enters the printable temperature range.

In FIG. 5A, the time t4 is a point when the carrying of the recording medium 101 and the fusion temperature control for the fuser 120 are resumed. The time t5 is a point when the check as to whether the surface temperature of the fusion roller 121 has entered the printable temperature range is commenced after resuming the carrying of the recording medium 101. The times from t4 to t5 is preferably set to secure time for the charging of the photosensitive drum 110 to stabilize and time for the surface temperature of the fusion roller 121 to have an increasing transition. As an example for the time for the charging of the photosensitive drum 110 to stabilize, it is appropriate to secure the time during which the photosensitive drum 110 rotates at least 1 to 2 times.

As shown in FIG. 5A, if the surface temperature of the fusion roller 121 is not within the printable temperature range at the time t5, the fusion roller 121 is warmed up while the blank section is being printed until the surface temperature of the fusion roller 121 enters the printable temperature range. On the other hand, as shown in FIG. 5B, if the surface temperature of the fusion roller 121 is within the printable temperature range at the time t5, the process moves to S8 and starts the image formation.

S8: The controller 201 that has determined that the surface temperature of the fusion roller 121 is within the printable temperature range outputs an instruction to the image forming part 202 to form an image. Upon receipt of the instruction, the image forming part 202 forms the image based on the print data received from the host device and performs the printing.

S9: The controller 201 ends the print process when the entire printing of the received print data is completed. The winding of the recording medium 101 by the winding part 208 is also stopped. In addition, the controller 201 may store in the storage part 210 a state that the recording medium 101 is not wound on the winding part 208.

As described above, by setting to the storage part 210 in advance the stop time for carrying the recording medium 101 necessary for attaching the front end of the recording medium 101 to the core of the winding part 208 and by stopping the carrying of the recording medium 101 and the fusion temperature control for the fuser 120 based on the set stop time, decrease of the surface temperature of the fusion roller 121 of the fuser 120 is controlled at the minimum level, and the carrying of the recording medium 101 until the surface temperature of the fusion roller 121 reaches the printable temperature range is suppressed. Therefore, the printing (feeding) of the unnecessary length of blank section is reduced. In addition, by controlling the decrease of the surface temperature of the fusion roller 121 at the minimum level, power consumption by the heater to heat the fusion roller 121 is reduced.

As described above, according to the first embodiment, the stop time for the recording medium necessary for attaching the front end of the recording medium to the core of the winding part is set in advance, and the carrying of the recording medium and the fusion temperature control for the fuser are stopped based on the set stop time. Therefore, there is an advantage that the printing (feeding) of the unnecessary length of blank section is reduced. In addition, there is an advantage that the power consumption of the heater that heats the fusion roller is reduced.

Second Embodiment

The configuration of the second embodiment is different from the configuration of the first embodiment in that the second embodiment includes an input part that receives an input operation from the operator. The configuration of the second embodiment is explained based on the block diagram in FIG. 6 that illustrates a configuration of an image forming device according to the second embodiment. Explanation of parts that are similar to the first embodiment and that are identified by the same reference numerals is omitted.

Figure 6:
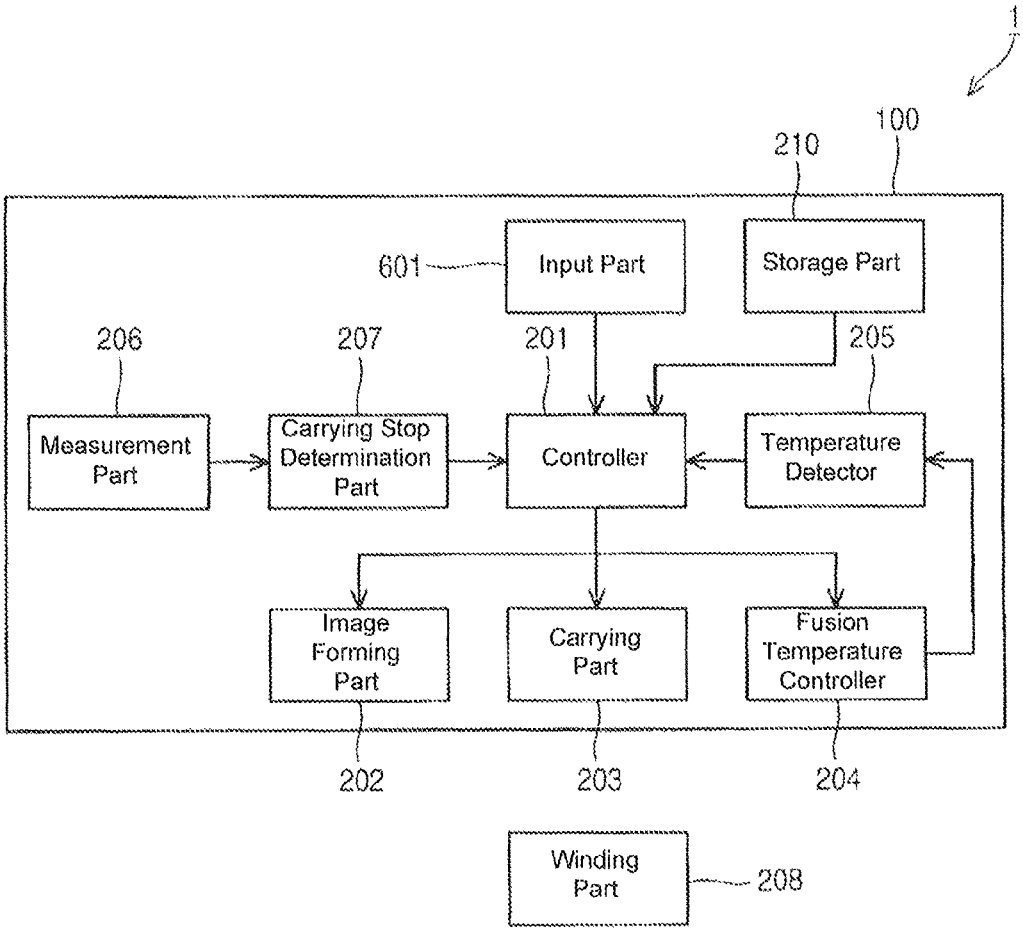
FIG. 6 is a block diagram illustrating a configuration of an image forming device according to the second embodiment.
Figure 9:
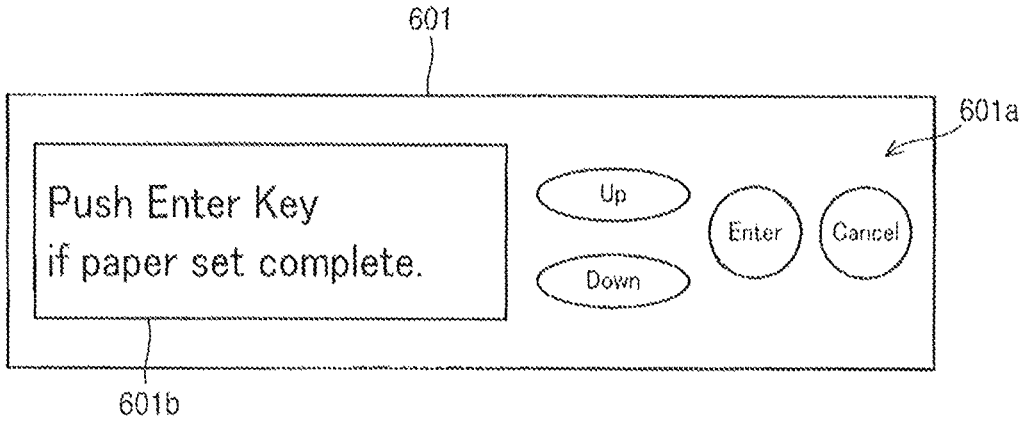
FIG. 9 is a diagram explaining an input part in the first embodiment.

In FIG. 6, an input part 601 is configured from operation keys, a touch panel and the like for receiving input operations from the operator and notifies the controller 201 of information of key inputs received from the operator. The input part 601 is an operation panel or the like provided on a front side of the electrographic printer 100. The input part 601 is configured from operation keys 601*a* including an "Enter" key, a "Cancel" key, an "Up" key, a "Down" key and the like, and a display 601*b* or the like that displays writings to guide operations, as shown in FIG. 9, for example. In the present embodiment, the input part 601 receives input operations to notify the controller 201 that the front end of the recording medium has been attached to the winding part 208.

Figure 7:
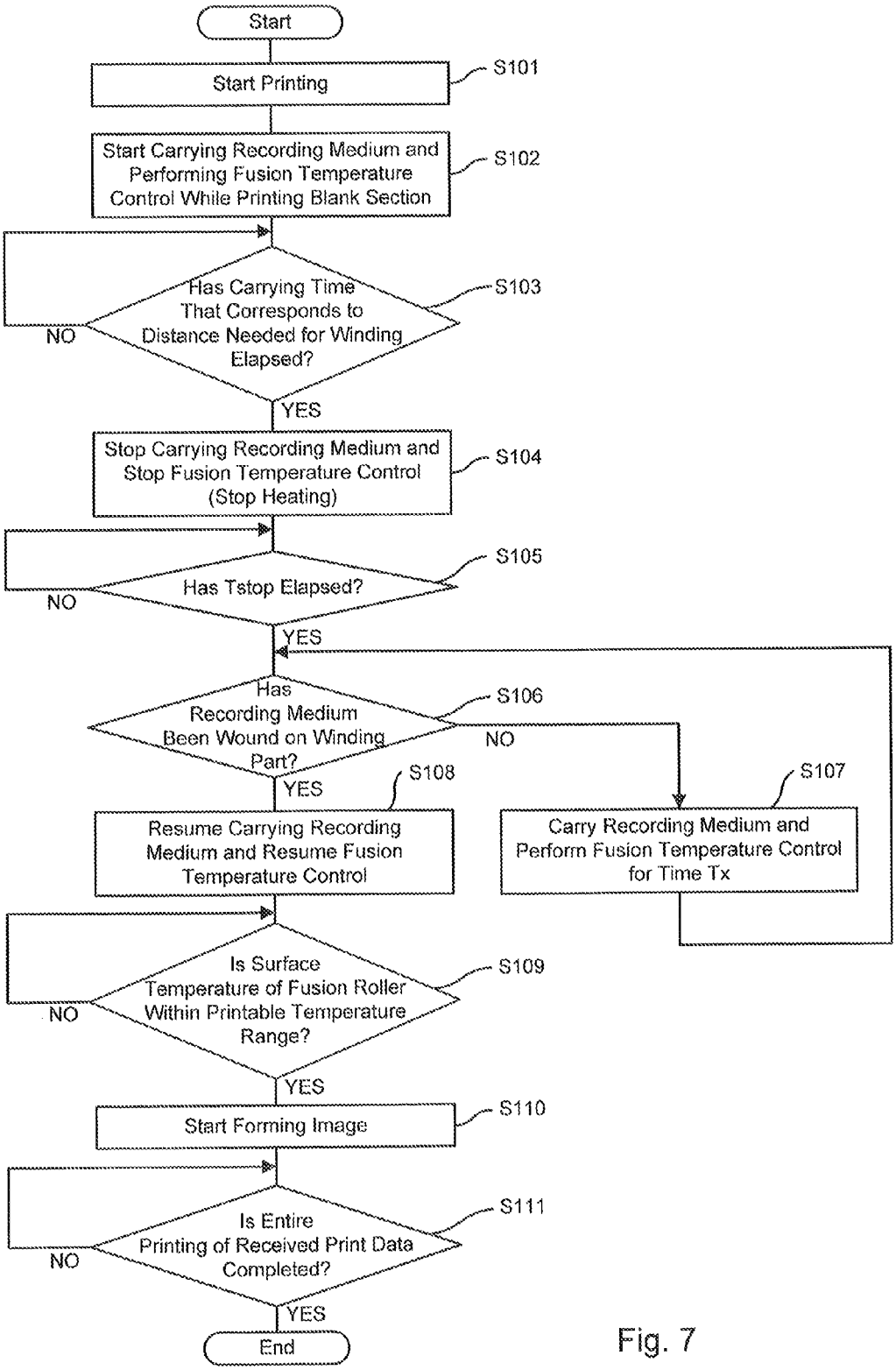
FIG. 7 is a flow diagram illustrating a print process in the second embodiment.

Operation of the above-described configuration is explained in accordance with steps indicated by "S" in a flow diagram of FIG. 7 illustrating a print process according to the first embodiment, with reference to FIGS. 6 and 2. First, the image forming device 1 is assumed to be in a state where the recording medium 101 has not been wounded on the winding part 208.

S101 to S105: These processes are the same as S1 to S5 in FIG. 3. Therefore, explanation is omitted.

S106: When the measurement part 206 detects the elapse of the stop time Tstop, the controller 201 determines whether or not the recording medium 101 is wound on the winding part 208, that is, whether or not there is a notice from the input part 601 of a key input operation by the operator indicating that the winding of the recording medium 101 on the winding part 208 has been completed. If the winding of the recording medium 101 onto the winding part 208 is determined to be completed, the process moves to S108. On the other hand, if the winding of the recording medium 101 onto the winding part 208 is not determined to be completed, the process moves to S107.

S107: The controller 201 that determined that the winding of the recording medium 101 onto the winding part 208 has not been completed even after the stop time Tstop had elapsed sends an instruction to the carrying part 203 to carry the recording medium 101 until time Txa elapses and sends an instruction to the fusion temperature controller 204 to perform the fusion temperature control (heating control by the heater) for the fuser 120 until time Txb elapses. The carrying part 203 that has received the instruction carries the recording medium 101 until the time Txa elapses. The fusion temperature controller 204 performs the fusion temperature control (heating control by the heater) for the fuser 120 with the target temperature for the fusion 120 being set above the lower limit of the printable temperature range for the recording medium 101, until the time Txb elapses. If the temperature detector 205 has detected that the surface temperature of the fusion roller 121 is within the printable temperature range, the fusion temperature control (heating control by the heater) for the fuser 120 is not performed.

The time Txa is time for carrying the recording medium 101 for a distance (carrying amount) that corresponds to a length of the contact part (nip part) of the fusion roller 121 and the pressure application roller 122 in the carrying direction of the recording medium. The distance is preferably at least about 10 mm. In addition, the time Txb is set to about a half of the time Txa to prevent excessively heating the recording medium 101.

When the carrying part 203 starts carrying the recording medium 101 and when the time Txa has elapsed, the process moves to S106, and the controller 201 waits for a notice of a key input operation by the operator using the input part 601 indicating that the winding of the recording medium 101 onto the winding part 208 has been completed.

S108: When the operator winds the recording medium 101 onto the winding part 208 and performs a key input using the input part 601, the controller 201, upon receipt of the notice of the key input operation by the operator using the input part 601 indicating that the winding of the recording medium 101 onto the winding part 208 has been completed, sends an instruction to the carrying part 203 to resume the carrying of the recording medium 101 and an instruction to the fusion temperature controller 204 to resume the fusion temperature control for the fuser 120. The carrying part 230 that has received the instruction resumes the carrying of the recording medium 101, and the fusion temperature controller 204 resumes the fusion temperature control (heating control by the heater) for the fuser 120. At the same time, by turning on a switch (not shown) for the winding part 208, the winding of the recording medium 101 is commenced. The winding may be automatically commenced by providing a sensor or the like to detect the ejection of the recording medium 101 from the electrographic printer 100 (fuser 120) or to detect the resuming of the carrying of the recording medium 101 by the carrying part 203, without providing the switch. The controller 201 at this time stores in the storage part 210 the state that the recording medium 101 is being wound on the winding part 208.

Figure 8:
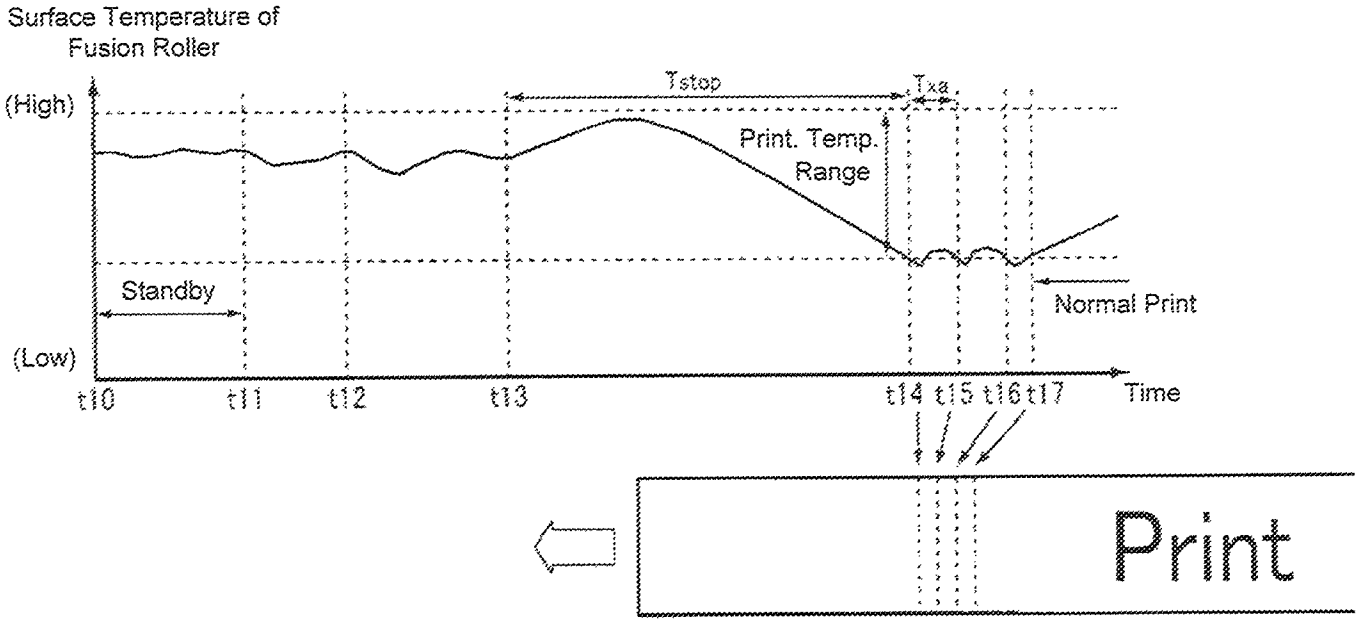
FIG. 8 is a diagram explaining a surface temperature of a fusion roller in the second embodiment.

FIG. 8 is a graph showing a change in the surface temperature of the fusion roller 121. The vertical axis indicates the surface temperature of the fusion roller 121, and the horizontal axis indicates the time elapsed. The times t10 to t14 in FIG. 8 are similar to the times t0 to t4 in FIG. 5A. Therefore, explanation is omitted. The time t15 indicates a time when the carrying part 203 has carried the recording medium 101 until the time Txa elapsed and when the fusion temperature controller 204 had performed the fusion temperature control (heating control by the heater) for the fuser 120 until the time Txa (about a half of the time Txa) has elapsed. In addition, when these operations are completed at the time t15, the controller 201 has not received a notice of a key input operation by the operator from the input part 601 indicating that the winding of the recording medium 101 onto the winding part 208 has been completed.

The time t16 indicates a time when the recording medium 101 has been carried again until the time Txa has elapsed and when the fusion temperature controller 204 has performed the fusion temperature control (heating control by the heater) for the fuser 120 again until the time Txa (about a half of the time Txa) has elapsed. At the time t16, the controller 201, upon receipt of the notice of the key input operation by the operator using the input part 601 indicating that the winding of the recording medium 101 onto the winding part 208 has been completed, sends an instruction to the carrying part 203 to resume the carrying of the recording medium 101 and an instruction to the fusion temperature controller 204 to resume the fusion temperature control for the fuser 120.

S109 to S111: These steps are similar to S7 to S9 in FIG. 3. Therefore, explanation is omitted. In addition, the time t17 in FIG. 8 is similar to the time t6 in FIG. 5A. Therefore, explanation is omitted.

As described above, the fusion temperature control is performed so that the surface temperature of the fusion roller 121 is not decreased less than the printable temperature range even if the time that the operator spent for attaching the recording medium 101 onto the winding part 208 becomes longer than the set stop time Tstop for the recording medium 101. Therefore, the carrying of the recording medium 101 is suppressed until the surface temperature of the fusion roller 121 reaches the printable temperature range after the attachment of the recording medium 101 onto the winding part 208 has been completed. Accordingly, the printing (feeding) of un unnecessary length of blank section is reduced. Moreover, misoperation by the operator can be prevented, and a problem at the time of winding of the recording medium 101 by the winding part 208 (e.g., oblique carrying of the recording medium 101) is also prevented.

As described above, according to the second embodiment, the fusion temperature control is performed so that the surface temperature of the fusion roller is not decreased less than the printable temperature range even if the time that the operator spent for attaching the recording medium onto the winding part becomes longer than the set stop time for the recording medium. Accordingly, there is an advantage that the printing (feeding) of an unnecessary length of blank section is reduced. Moreover, there are advantages that misoperation by the operator can be prevented and that a problem at the time of winding of the recording medium by the winding part (e.g., oblique carrying of the recording medium) is also prevented.

In the explanation above, the first and second embodiments are used in a color electrographic printer as an example. However, the application is not limited to this and may be implemented in a monochrome electrographic printer and the like. Furthermore, in the above-described embodiments, the surface temperature of the fuser is referenced. However, if a thermal transfer printer is used, the temperature of a thermal transfer head may be referenced, and the temperature control for the thermal transfer head may be performed so that the surface temperature of the thermal transfer head is not decreased below the printable temperature range. Furthermore, the recording medium may be a long sheet, such as a rolled sheet and a fan-folded sheet.

What is claimed is:

1. An image forming device, comprising:

a carrying part that carries a continuous length of a recording medium as the recording medium in a roll is unrolled;

an image forming part that forms a development image on the recording medium carried by the carrying part;

a fuser that thermally fixes the development image formed on the recording medium;

a fusion temperature controller that controls a temperature of the fuser in accordance with the carrying of the recording medium by the carrying part;

a winding part that winds the recording medium on which the development image is thermally fixed;

a measurement part that measures a stop time, during which the carrying part stops the carrying of the recording medium;

a storage part that stores the stop time for the recording medium as operation time for attaching a front end of the recording medium onto the winding part;

a controller that stops the carrying of the recording medium by the carrying part and heating by the fusion temperature controller, after the carrying part carries the recording medium by a predetermined length while the fusion temperature controller heats the fuser, when printing is started in a state where the recording medium is not wound on the winding part, and that resumes the carrying of the recording medium by the carrying part and the heating by the fusion temperature controller upon detection that the time measured by the measurement part has reached the stop time for the recording medium stored in the storage part; and a temperature detector that detects the temperature of the fuser and that notifies the controller of the detected temperature, wherein the image forming part starts forming the development image when the controller determines that the temperature of the fuser detected by the temperature detector is within a printable temperature range after the carrying of the recording medium by the carrying part and the heating by the fusion temperature controller are resumed.

2. The image forming device according to claim 1, wherein the predetermined length by which the carrying part carries the recording medium when the printing is started in the state where the recording medium has not been wound on the winding part corresponds to a distance for which the front end of the recording medium is carried to reach a core of the winding part.

3. The image forming device according to claim 1, wherein the fusion temperature controller heats up the fuser to a target temperature of the fuser that is higher than a median of the printable temperature range of the recording medium when the carrying part carries the recording medium.

4. The image forming device according to claim 1, further comprising:

an input part that receives an input operation that notifies the controller that the front end of the recording medium has been attached to the winding part, wherein the controller resumes the carrying of the recording medium by the carrying part and the heating by the fusion temperature controller when the input operation is received by the input part after the time measured by the measurement part has reached the stop time for the recording medium stored in the storage part.

5. The image forming device according to claim 4, wherein the fusion temperature controller heats up the fuser to a target temperature of the fuser that is higher than a lower limit of the printable temperature range of the recording medium from when the controller detects that the time measured by the measurement part has reached the stop time for the recording medium stored in the storage part to when the input operation is received by the input part.

6. The image forming device according to claim 5, wherein the controller causes the fusion temperature controller to heat the fuser while the controller causes the carrying part to carry the recording medium by a carrying amount that corresponds to a length of a contact part of a fusion roller and a pressure application roller of the fuser in a carrying direction of the recording medium.

7. An image forming device, comprising:

a fuser roller that thermally fixes a development image formed on a recording medium;

a winding part that winds the recording medium; and a controller that sends an instruction to stop carrying of the recording medium and a fusion temperature control for the fuser for a predetermined amount of time after a predetermined length of the recording medium has been carried before image formation begins, and that sends an instruction to resume the carrying of the recording medium and the fusion temperature control after at least one of the predetermined amount of time has elapsed and an input from an operator has been received, wherein the predetermined amount of time corresponds to time needed for a front edge of the recording medium to be attached to the winding part.

8. The image forming device according to claim 7, wherein the predetermined amount of time is 10 to 30 seconds.

9. The image forming device according to claim 7, wherein the controller sends an instruction to start forming an image after the carrying of the recording medium and the fusion temperature control have been resumed and after a surface temperature of the fusion roller reaches a lower limit of a printable temperature range for the recording medium.

10. The image forming device according to claim 7, wherein a surface temperature of the fusion roller when the carrying of the recording medium and the fusion temperature control are stopped is maintained above the median of a printable temperature range for the recording medium such that the surface temperature is maintained around or above a lower limit of the printable temperature range at the time when the carrying of the recording medium and the fusion temperature control are resumed.

11. The image forming device according to claim 7, wherein when the receipt of the input from the operator takes places after the predetermined amount of time, and when the carrying of the recording medium and the fusion temperature control are resumed after the receipt of the input from the operator, the fusion roller is heated so that the surface temperature of the fusion roller is maintained around or above the lower limit of the printable temperature range.

12. An image forming device, comprising:

a carrying part that carries a continuous length of a recording medium as the recording medium in a roll is unrolled;

an image forming part that forms a development image on the recording medium carried by the carrying part;

a fuser that thermally fixes the development image formed on the recording medium;

a fusion temperature controller that controls a temperature of the fuser in accordance with the carrying of the recording medium by the carrying part;

a winding part that winds the recording medium on which the development image is thermally fixed;

a measurement part that measures a stop time, during which the carrying part stops the carrying of the recording medium;

a storage part that stores the stop time for the recording medium as operation time for attaching a front end of the recording medium onto the winding part; and a controller that stops the carrying of the recording medium by the carrying part and heating by the fusion temperature controller, after the carrying part carries the recording medium by a predetermined length while the fusion temperature controller heats the fuser, when printing is started in a state where the recording medium is not wound on the winding part, and that resumes the carrying of the recording medium by the carrying part and the heating by the fusion temperature controller upon detection that the time measured by the measurement part has reached the stop time for the recording medium stored in the storage part, wherein the predetermined length by which the carrying part carries the recording medium when the printing is started in the state where the recording medium has not been wound on the winding part corresponds to a distance for which the front end of the recording medium is carried to reach a core of the winding part.

13. The image forming device according to claim 12, wherein the fusion temperature controller heats up the fuser to a target temperature of the fuser that is higher than a median of the printable temperature range of the recording medium when the carrying part carries the recording medium.

14. The image forming device according to claim 12, further comprising:

an input part that receives an input operation that notifies the controller that the front end of the recording medium has been attached to the winding part, wherein the controller resumes the carrying of the recording medium by the carrying part and the heating by the fusion temperature controller when the input operation is received by the input part after the time measured by the measurement part has reached the stop time for the recording medium stored in the storage part.

15. The image forming device according to claim 14, wherein the fusion temperature controller heats up the fuser to a target temperature of the fuser that is higher than a lower limit of the printable temperature range of the recording medium from when the controller detects that the time measured by the measurement part has reached the stop time for the recording medium stored in the storage part to when the input operation is received by the input part.

16. The image forming device according to claim 15, wherein the controller causes the fusion temperature controller to heat the fuser while the controller causes the carrying part to carry the recording medium by a carrying amount that corresponds to a length of a contact part of a fusion roller and a pressure application roller of the fuser in a carrying direction of the recording medium.

* * * * *